US005759163A

United States Patent [19]

Hwang

[11] Patent Number: 5,759,163

[45] Date of Patent: Jun. 2, 1998

[54] BREAST MASSAGER

[76] Inventor: Jong H. Hwang, 333 S. Westminster Ave., No. 105, Los Angeles, Calif. 90020

[21] Appl. No.: 839,431

[22] Filed: Apr. 10, 1997

[51] Int. Cl.[6] ..... A61H 15/00

[52] U.S. Cl. ..... 601/113; 601/118; 601/122; 601/126; 601/128

[58] Field of Search ..... 601/11, 14, 74, 601/81, 85, 87, 94, 112, 113, 114, 122, 118, 126, 128, 132, 134; 606/204.15

[56] References Cited

U.S. PATENT DOCUMENTS

| | | | |
|---|---|---|---|
| 927,125 | 7/1909 | Davis . | |
| 1,631,792 | 6/1927 | Burnley . | |
| 1,899,208 | 2/1933 | Murphy . | |
| 2,222,523 | 11/1940 | Williams . | |
| 2,232,474 | 2/1941 | Rauh . | |
| 2,258,931 | 10/1941 | Heer et al. . | |
| 3,077,878 | 2/1963 | Baulard-Cogan . | |
| 3,667,455 | 6/1972 | Courtin | 601/166 |

*Primary Examiner*—Danton D. DeMille
*Attorney, Agent, or Firm*—John K. Park; Law Offices of John K. Park & Associates

[57] ABSTRACT

A breast massager including: (a) a cup for supporting a breast, the cup having an inner surface for supporting the breast, a tip corresponding to the tip of the breast, and an opening at the tip of the cup; (b) a rotator attached to the tip of the cup, the rotator having a rotating shaft protruding into the cup via the opening at the tip of the cup; (c) at least one flexible rod having a length, a first end and a second end, the first end of the rod being attached to the rotating shaft of the rotator in the cup, the rod being capable of conforming to the inner surface of the cup; and (d) a plurality of skin-contacting elements attached to the rod along the length of the rod; wherein, the rotator is capable of sweeping the rod along at least a portion of the inner surface of the cup to roll the skin-contacting elements against a breast supported by the inner surface of the cup.

17 Claims, 5 Drawing Sheets

BREAST MASSAGER

BACKGROUND

The present invention relates generally to massaging apparatus and in particular to breast massaging apparatus for women.

It has been known for a number of years that massaging the breast area provides significant therapeutic and medicinal benefits. For example, massaging the breast area stimulates the breast tissue, drawing more blood to the breast tissue. This increased blood flow provides the breast tissue with nutrients needed to keep the breasts healthy. The increased blood flow also removes toxic chemicals from the breast area, reducing the risk of diseases such a breast cancer.

Conventional breast massager include a massager such as a vibrator that a user must apply to the breast area. However, such massagers are undesirable because the user must constantly move the vibrating area of the massager around the breast area to provide uniform massaging effect to the entire breast area. Further, such massagers require the user to take time from daily activity to undress and apply the massagers.

To alleviate the above problems, some massagers are shaped as bras with a stiff frame covering each breast and a number of massaging rollers attached to the stiff frame for massaging breasts. A problem with such massagers is that the massaging rollers are limited to a small area of the breasts, only massaging a fraction of the breast area. Further, the massaging rollers are unpowered, requiring a user to manually roll the massaging rollers over the breast area. Also, the stiff frames are uncomfortable to wear for any length time because they are heavy, cumbersome and visually distasteful for use as undergarment bras.

There is, therefore, a need for a breast massager which provides uniform massaging over a substantial area of a breast. There is also a need for the breast massager to be light, flexible and easy to wear. There is also a need for the breast massager to be powered.

SUMMARY

The present invention satisfies these needs. The present invention provides a breast massager comprising: (a) a cup for supporting a breast, the cup having an inner surface for supporting the breast, a tip corresponding to the tip of the breast, and an opening at the tip of the cup; (b) a rotator attached to the tip of the cup, the rotator having a rotating shaft protruding into the cup via the opening at the tip of the cup; (c) at least one flexible rod having a length, a first end and a second end, the first end of the rod being attached to the rotating shaft of the rotator in the cup, the rod being capable of conforming to the inner surface of the cup; and (d) a plurality of skin-contacting elements attached to the rod along the length of the rod; wherein, the rotator is capable of sweeping the rod along at least a portion of the inner surface of the cup to roll the skin-contacting elements against a breast supported by the inner surface of the cup.

Preferably, the breast massager comprises two flexible rods, each rod having a length, a first end and a second end, the first end of the rod being attached to the rotating shaft of the rotator in the cup. The rods are capable of conforming to the inner surface of the cup, and a plurality of skin-contacting elements are attached to each rod along the length of the rod. The rotator is capable of sweeping the rods along at least a portion of the inner surface of the cup to roll the skin-contacting elements against a breast supported by the inner surface of the cup. The rods are positioned opposite one another other in the cup to provide uniform massaging of the breast. Preferably, the rotator further includes a driver for rotating the rotating shaft to alleviate the need for manual massaging.

In a preferred embodiment, the present invention provides a breast massager comprising: (a) a pair of cups for supporting a pair of breasts, each cup having an inner surface for supporting a breast, a tip corresponding to the tip of a breast, and an opening at the tip of the cup; (b) a pair of rotators, each rotator attached to the tip of a cup, each rotator having a rotating shaft protruding into a corresponding cup via the opening at the tip of the cup; (c) a pair of flexible rods in each cup, each rod having a length, a first end and a second end, the first end of each rod being attached to the rotating shaft of a rotator in the corresponding cup, the rod being capable of conforming to the inner surface of the cup; (d) a plurality of skin-contacting elements attached to each rod along the length of each rod; wherein, each rotator is capable of sweeping the rods in a corresponding cup along at least a portion of the inner surface of the cup to roll the skin-contacting elements against a breast supported by the inner surface of the cup; (e) a connector for connecting the cups to one another to form a bra; and (f) at least one strap attached to the cups for supporting the cups on the body of a wearer.

DRAWINGS

These and other features, aspects, and advantages of the present invention will become better understood with regard to the following description, appended claims, and accompanying drawings which illustrate examples of the invention, where:

Figure 1:
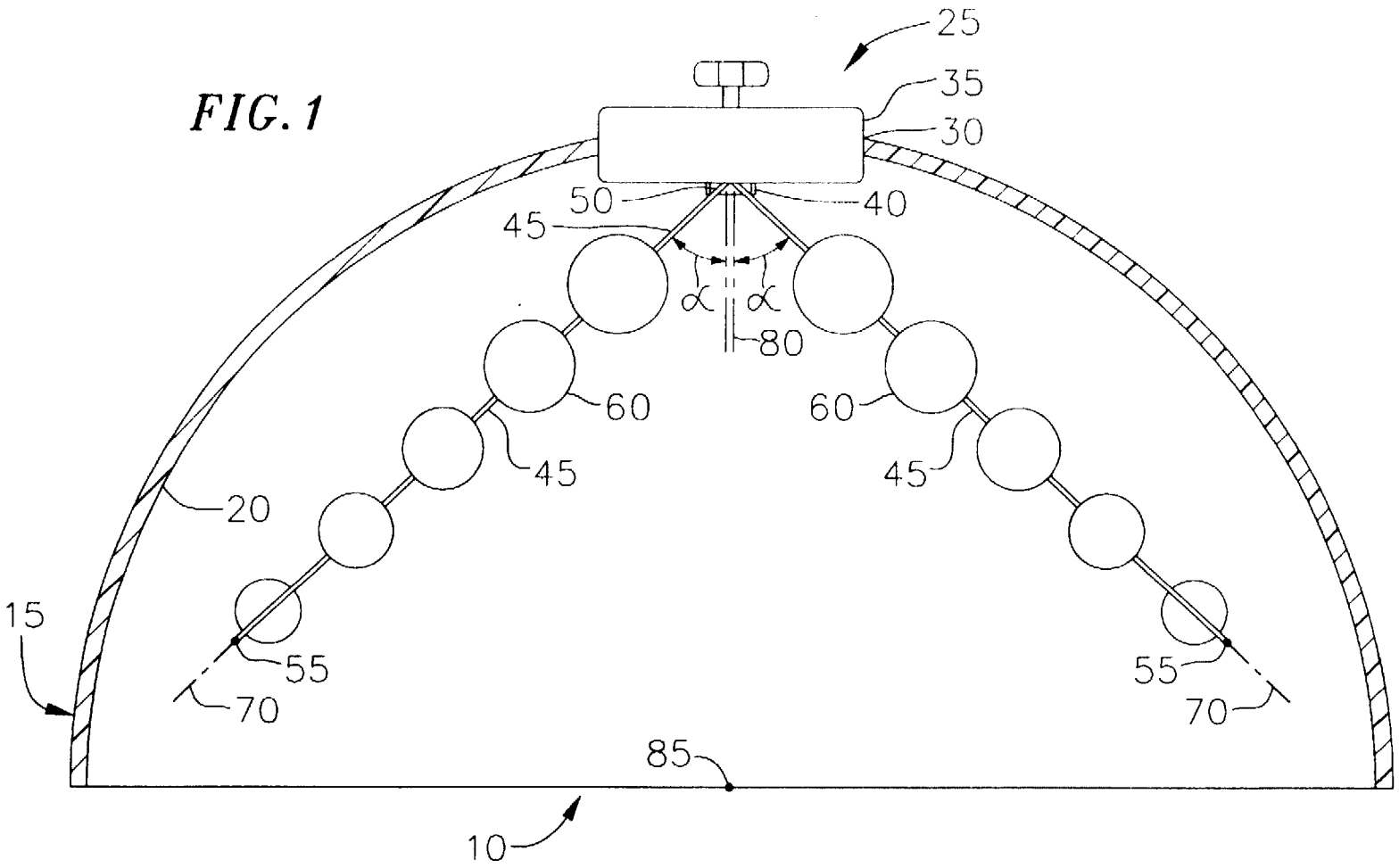
FIG. 1 is a schematic cross-sectional view of an embodiment of a breast massager according to the present invention.
Figure 5A:
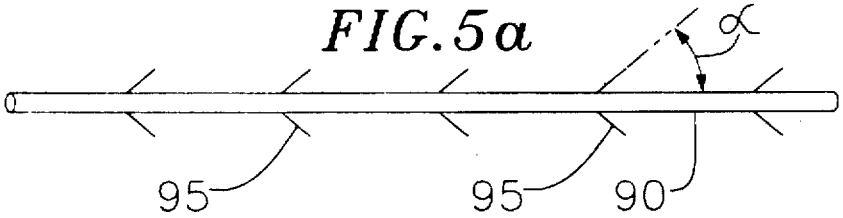
Figure 5B:
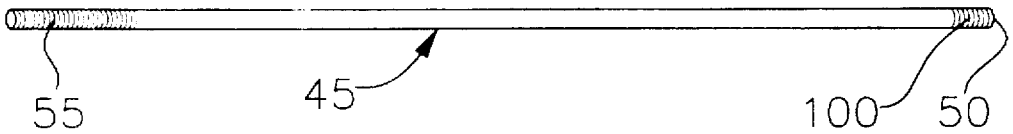
Figure 6A:
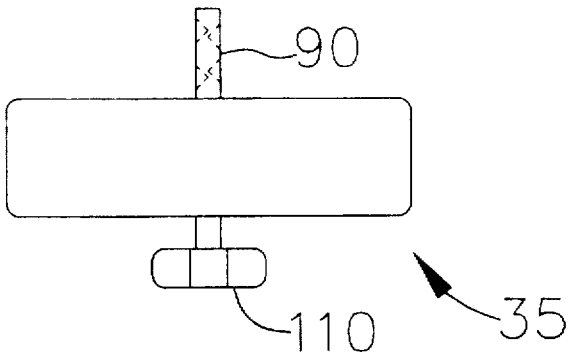
Figure 6B:
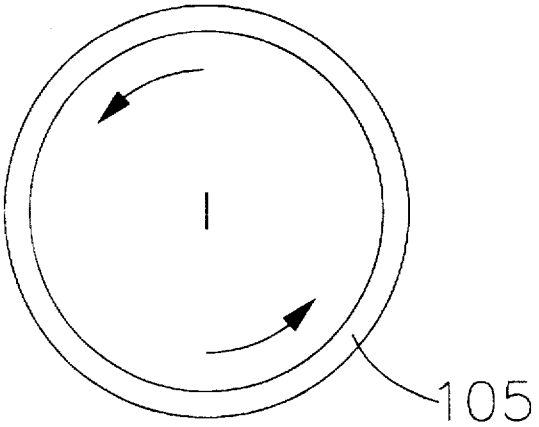

FIG. 5*a* is a schematic cross-sectional view of the rotating shaft of the rotator of the breast massager FIG. 1;

FIG. 5*b* is a partial perspective view of the flexible rod of FIG. 1 with a hollow pocket at its first end;

FIG. 6*a* is schematic cross-sectional view of the rotator of the breast massager of FIG. 1;

FIG. 6*b* is a schematic cross-sectional view of the tape spring of the rotator of FIG. 6*a;*

Figure 7:
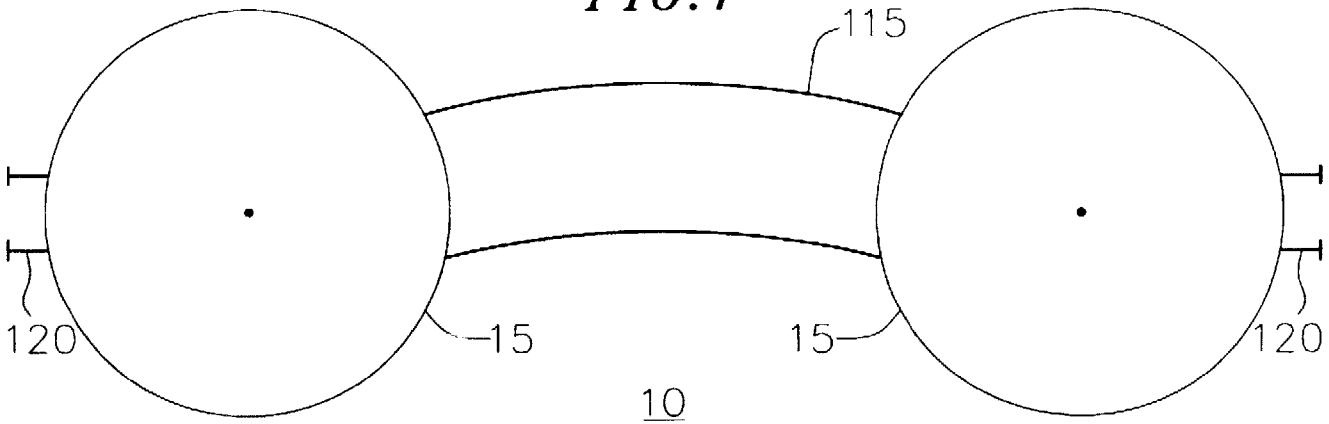
Figure 8:
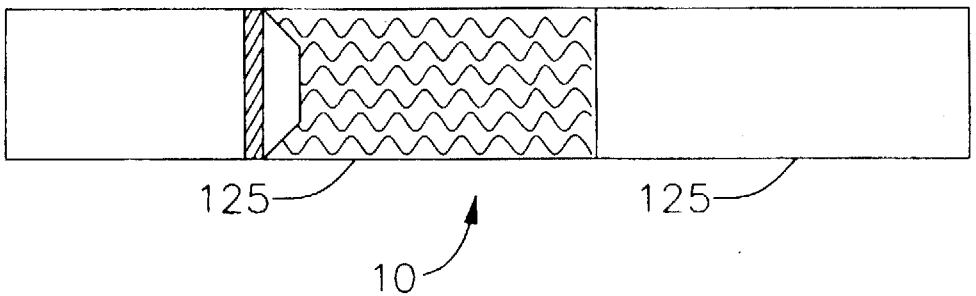

FIG. 7 is a front view of another embodiment of a breast massager in the form of a bra according to the present invention; and FIG. 8 is a schematic view of straps for holding the breast massager of FIG. 7 to the body of a wearer.

DESCRIPTION

Referring to FIG. 1, a breast massager 10 according to the present invention comprises: (a) a cup 15 for supporting a breast, the cup 15 having an inner surface 20 for supporting the breast, a tip 25 corresponding to the tip of the breast, and an opening 30 at the tip 25 of the cup 15; (b) a rotator 35 attached to the tip 25 of the cup 15, the rotator 35 having a rotating shaft 40 protruding into the cup 15 via the opening 30 at the tip 25 of the cup 15; (c) at least one flexible rod 45 having a length, a first end 50 and a second end 55, the first end 50 of the rod 45 being attached to the rotating shaft 40 of the rotator 35 in the cup 15, the rod 45 being capable of conforming to the inner surface 20 of the cup 15; and (d) a plurality of skin-contacting elements 60 attached to the rod 45 along the length of the rod 45; wherein, the rotator 35 is capable of sweeping the rod 45 along at least a portion of the inner surface 20 of the cup 15 to roll the skin-contacting elements 60 against a breast supported by the inner surface 20 of the cup 15.

Figure 2:
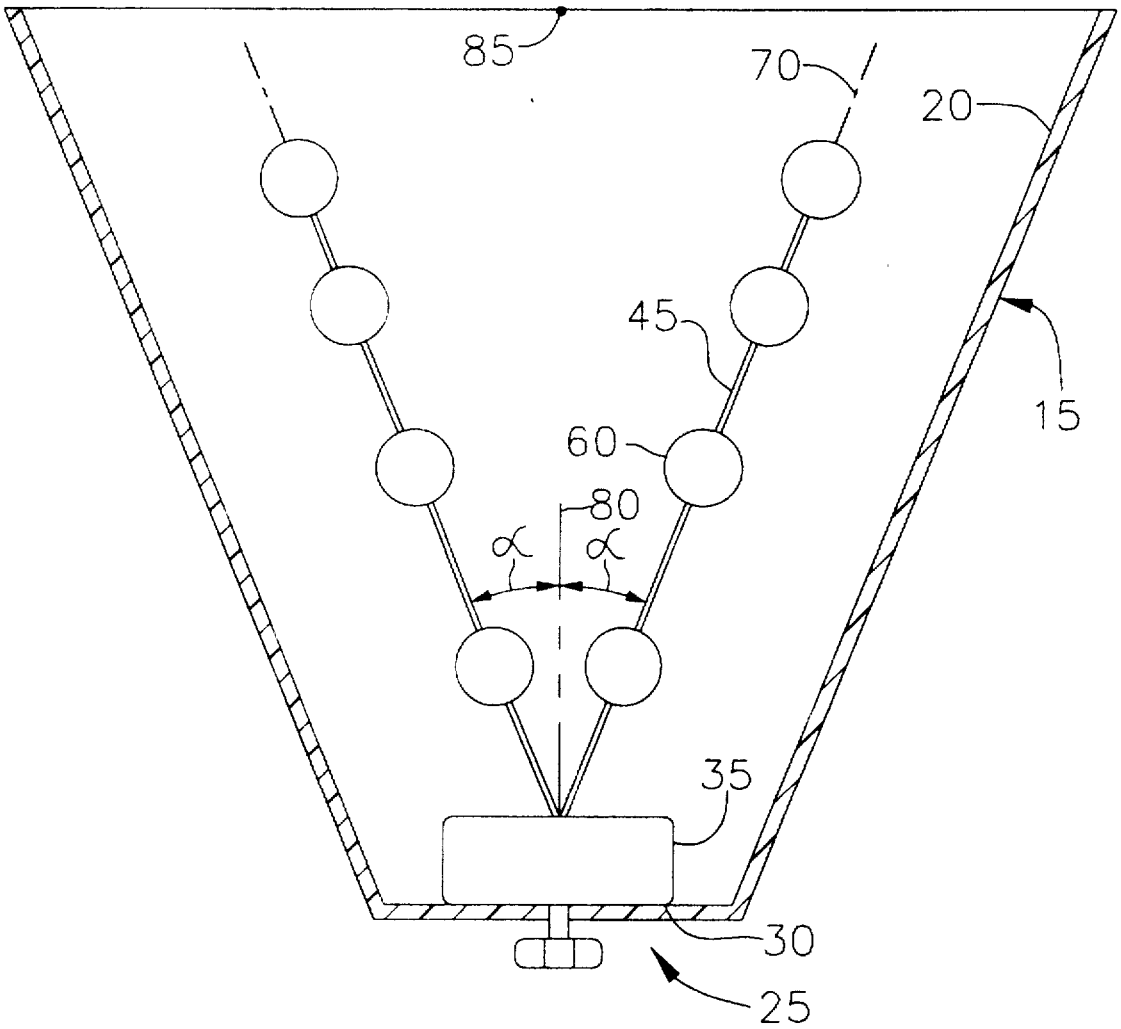
FIG. 2 is a schematic cross-sectional view of another embodiment of a breast massager according to the present invention.

The cup 15 comprises a shell shaped and sized to receive and support a breast therein. For example, the shape and size of the shell can correspond to the shape and size specifications used by the undergarment industry such as A, B, C, D, DD, etc. In FIG. 1, the cup 15 is shaped substantially as a hemisphere with an example diameter of about 10 cm to about 25 cm. In FIG. 2, the cup 15 is shaped substantially as a partial cone with a base diameter of about 10 cm to about 25 cm and a height of about 10 cm to about 35 cm.

The shell can be made from a resilient material such as plastics, rubber, etc. The shell can also be made from a flexible material such as two layers of cotton with cross stitching to make the cup 15 resilient. The cup 15 can also include a resilient material embedded in the shell to maintain the structural integrity of the cup 15. Preferably, the shell is made from a material than can be washed and cleaned as desired to keep the breast massager in a sanitary condition.

The opening 30 at the tip 25 of the cup 15 is shaped and sized to receive and hold the rotator 35 as shown in FIGS. 1 and 2. For example, the opening 30 can be circular with a diameter of about 1 cm to about 4 cm. Other shapes and sizes for the opening 30 are also contemplated by the present invention. The cup 15 can include additional resilient material near the opening 30 at the tip 25 of the cup 15 to provide further support and an anchor area for the rotator 35. The inner surface 20 of the cup 15 can be lined to provide an added measure of support and comfort to the wearer.

Figure 3:
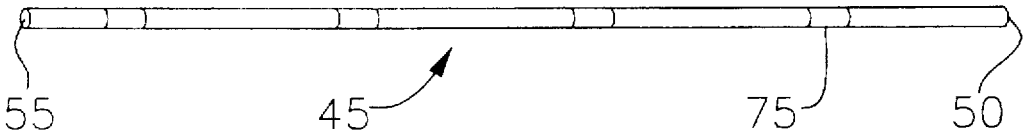
FIG. 3 is a schematic cross-sectional view of the flexible rod of the breast massager of FIG. 1.

Referring to FIG. 3, the flexible rod 45 can be any resilient coilable material such as plastic, metal, rubber and the like capable of bending and conforming to the surface of a breast. When a breast is inserted in the cup 15, the breast pushes against the rod 45, bending the rod 45 to conform to the shape of the breast.. As such, the rod 45 is positioned between the breast and the inner surface 20 of the cup 15. The uncoiling force of the rod 45 uniformly presses the rod 45, and the skin-contacting elements 60, against the breast.

The flexible rod 45 can be selected to provide an uncoiling force as desired. Preferably, the flexible rod 45 is selected so that uncoiling force of the of the rod 45 does not place excessive pressure against the breast. The length of the rod 45 can be selected to provide as large a massage area as is necessary. Preferably, the length of the rod 45 is selected to provide massaging to substantially the entire breast surface covered by the cup 15. For example, the rod 45 can be from about 5 cm to about 30 cm in long, and about 0.1 cm to about 1 cm in thickness.

Figure 4:
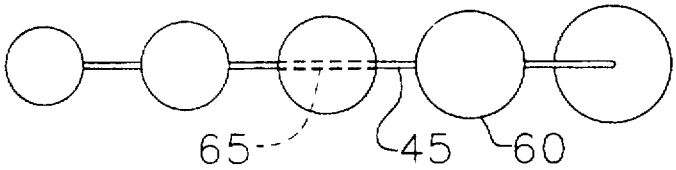
FIG. 4 is a schematic cross-sectional view of the flexible rod of the breast massager of FIG. 3 with skin-contacting elements.

Referring to FIG. 4, the skin-contacting elements 60 are adapted for direct engagement with the skin to provide a massaging and stimulating effect to the breast. The skin-contacting elements 60 can be of a desired shape and material such as rubber, metal, synthetic resin, solid or hollow, spherical, elliptical or otherwise. The surfaces of the skin-contacting elements 60 can be the same or differently shaped to enhance massaging and stimulating action. Said surfaces may be smooth, ribbed, networked, have depressions, have projections, etc.

In the embodiment shown in the drawings, the skin-contacting elements 60 are wooden spheres, each having a shaft 65 to allow the rod 45 to pass therethrough. The spheres can have a radius of about 0.25 cm to about 2 cm as desired. The shafts 65 are sized to allow the spheres to freely rotate along the axis 70 of the rod 45. The radii of the spherical elements can be the same for all the spheres as shown in FIG. 2, or can decrease along the length of the rod 45 from the first 50 and to the second end 55 of the rod 45 as shown in FIG. 1. For example the radii of the spheres can decrease from about 1 cm to about 0.5 cm along the length of the rod 45.

Each skin-contacting element 60 is held in place along the length of the rod 45 and prevented from sliding along the length of the rod 45 by stoppers 75. The stoppers 75 can be washers sandwiching each skin-contacting element 60, or protrusions along the rod 45, with protrusions having a larger radius than the shafts 65 in case of spherical skin-contacting elements 60. Where the spheres are hollow, the stoppers 75 can include a protrusion on the portion of the rod 45 within the sphere, said protrusion having a larger diameter than the shafts 65 through the spheres to keep the spheres from sliding along the length of the rod 45.

Preferably, the skin-contacting elements 60 are uniformly spaced along the length of the rod 45 to provide uniform massaging action to the breast. The number of the skin-contacting elements 60 depends on the size of each skin-contacting element 60 and the length of the rod 45. In the embodiment of the invention shown in FIG. 1 each rod 45 carries 5 skin-contacting elements 60, and in the embodiment of the invention shown in FIG. 2 each rod 45 carries 4 skin-contacting elements 60.

Referring to FIGS. 1 and 2, the rod 45 is attached to the rotating shaft 40 of the rotator 35 protruding into the cup 15 from the opening 30 at the tip 25 of the cup 15. The rotating shaft 40 has an axis of rotation 80 substantially perpendicular to the inner surface 20 of the cup 15, passing through a center 85 of the cup 15. The first end 50 of the rod is attached to the rotating shaft 40 such that the rod 45 forms an angle with the axis of the rotation 80 of the rotating shaft 40. The angle can range from about 30 degrees to about 60 degrees, and is preferably between about 40 degrees and 50 degrees.

In the example shown in the drawings, the rotating shaft 40 includes a post 90 having one or more attachment extensions 95 forming the angle with the post 90 as shown in FIG. 5*a*. The post 90 can, for example, be about 0.1 cm to about 4 cm in length, and about 0.1 to about 1 cm in thickness. The attachment extension can be about 0.05 cm to about 1 cm in thickness and about 0.05 cm to about 1 cm in length. In this case, the first end 50 of the rod 45 can include a pocket 100 shaped and sized to receive and hold one of the attachment extensions 95 of the post 90 as shown in FIG. 5*b*. The first end 50 of the rod 45 can also be pivotally attached to the rotating shaft 40 such that the rod 45 can pivot from a central position wherein it is substantially perpendicular to the inner surface 20 of the cup 15, to a side position wherein it forms the angle with the axis of rotation 80 of the rotating shaft 40.

Referring to FIG. 6*a*, the rotator 35 can include a driver 105 for rotating the rotating shaft 40. The driver 105 can be a spring, electrical motor or other means of rotating the rotating shaft 40 along the axis of rotation 80. When using an electrical motor, a power supply must be stored in the breast massager 10 or carried on a part of the user's body to power the rotator 35.

In the embodiment of the invention shown in the drawings, the driver 105 is a spring which can be wound using a knob 110 attached to the spring. Winding the knob 110 winds the spring storing potential energy into the spring. The spring is attached to the rotating shaft 40 such that when the spring uncoils, the spring rotates the rotating shaft 40 along its axis of rotation 80. The spring can be any coilable material capable of storing potential energy by being wound and capable of releasing the potential energy over a period of time rather than in a burst to allow smooth and uniform rotation of the rotating shaft 40 and the rod 45 to provide relaxing and uniform massaging. For example, the spring can be a tape spring stored in the driver as shown in FIG. *6b*.

After winding, the spring can be allowed to uncoil to rotate the rotating shaft 40 which in turn sweeps the rod 45 along the inner surface 20 of the cup 15 and rolls the skin-contacting elements 60 over the skin of a breast in the cup 15. The rotating shaft 45 can rotate clockwise or counter-clockwise as desired using a shifter to reverse the direction of rotation of the rotating shaft 45. The rate of rotation of the rotating shaft 40 can be selected as desired for comfort level and massaging effect. For example, the rotation rate of the rotating shaft 40 can be about 1 rpm to about 50 rpm.

To provide more uniform and balanced massaging, the breast massager 10 preferably includes two flexible rods 45 as described above. Both rods 45 are sized and shaped as described above and carry the skin-contacting elements 60. The rods 45 are attached to the rotating shaft 40 of the rotator 35 as described above. In the example shown in the drawings, the post 90 of the rotator 35 includes at least two attachment extensions 95 symmetrically protruding from the post 90 at opposing sides of the post 90, each attachment extension 95 forming the angle with respect to the axis of rotation 80 of the post 90. Each rod 45 includes a pocket 100 at its first end 50 shaped and sized to receive and hold an attachment extension 95 of the post 90.

Preferably, the rods 45 are spaced apart and positioned opposite one another in the cup 15. As such, the rods 45 are symmetrically positioned in the cup 15 with respect to the rotating shaft 40. Each rod 45 forms the angle with the axis of rotation 80 of the rotating shaft 40 shaft ranging from about 30 degrees to about 60 degrees, and preferably from about 40 degrees to about 50 degrees. The rotator 35 is capable of sweeping both rods 45 along at least a portion of the inner surface 20 of the cup 15 to roll the skin-contacting elements 60 against a breast supported by the inner surface 20 of the cup 15. A breast massager 10 according to the present invention can also include three or more flexible rods 45 in the cup 15 as desired.

Referring to FIG. 7, in another embodiment, a breast massager 10 according to the present invention comprises: (a) a pair of cups 15 for supporting a pair of breasts, each cup 15 having an inner surface 20 for supporting a breast, a tip 25 corresponding to the tip of a breast, and an opening 30 at the tip 25 of the cup 15; (b) a pair of rotators 35, each rotator 35 attached to the tip 25 of a cup 15, each rotator 35 having a rotating shaft 40 protruding into a corresponding cup 15 via the opening 30 at the tip 25 of the cup 15; (c) a pair of flexible rods 45 in each cup 15, each rod 45 having a length, a first end 50 and a second end 55, the first end 45 of each rod 45 being attached to the rotating shaft 40 of a rotator 35 in the corresponding cup 15, the rod 45 being capable of conforming to the inner surface 20 of the cup 15; (d) a plurality of skin-contacting elements 60 attached to each rod 45 along the length of each rod 45; wherein, each rotator 35 is capable of sweeping the rods 45 attached to the rotator 35 in a corresponding cup 15 along at least a portion of the inner surface 20 of the cup 15 to roll the skin-contacting elements 60 against a breast supported by the inner surface 20 of the cup 15 as described above.

The breast massager 10 further comprises a connector 115 for connecting the cups 15 to one another to form a bra, and at least one strap 120 attached to the cups 15 for supporting the cups 15 on the body of a wearer.

In this embodiment, the breast massager 10 is in the form of a bra that can be worn on the body of a wearer. It also provides mobility to the wearer as the wearer can simply wear the bra without the need for holding the cups 15 against the breasts of the wearer. The massager 10 can also be worn under clothing for everyday use as desired.

The connector 115 can be made from a resilient material such as plastics or robber. The connector 115 can also be made from a flexible material such as cotton, Spandex (TM), etc. known to the practitioners in the industry. The straps 120 can include a variety of shapes and attachments to the cups 15. In the example embodiment of the invention shown in FIG. 7, the straps 120 include a strip of flexible material attached to the cups 15.

Referring to FIG. 8, the strip includes fasteners 125 to allow a wearer to fasten the strips at the back of a wearer to hold the massager 10 in place. The fasteners 125 can include buttons, hooks, hook and loop materials such as Velcro (TM), etc. In the example embodiment shown in FIG. 8, the fasteners 120 are Velcro (TM) strips attached to the cups 15 such that the massager 10 can be easily worn by wearer by fastening the Velcro strips to one another at the back of the wearer. The straps 120 can also include suspenders attached to the cups 15 to suspend the cups 15 from the shoulders of a wearer as is known in the undergarment industry.

Although the present invention has been described in considerable detail with regard to the preferred versions thereof, other versions are possible. Therefore, the appended claims should not be limited to the descriptions of the preferred versions contained herein.

What is claimed is:

1. A breast massager comprising:

(a) a cup for supporting a breast, the cup having an inner surface for supporting the breast, a tip corresponding to the tip of the breast, and an opening at the tip of the cup;

(b) a rotator attached to the tip of the cup, the rotator having a rotating shaft protruding into the cup via the opening at the tip of the cup;

(c) at least one flexible rod having a length, a first end and a second end, the first end of the rod being attached to the rotating shaft of the rotator in the cup, the rod being capable of conforming to the inner surface of the cup; and (d) a plurality of skin-contacting elements attached to the rod along the length of the rod;

wherein, the rotator is capable of sweeping the rod along at least a portion of the inner surface of the cup to roll the skin-contacting elements against a breast supported by the inner surface of the cup.

2. The breast massager of claim 1 comprising two flexible rods, each rod having a length, a first end and a second end, the first end of the rod being attached to the rotating shaft of the rotator in the cup, the rod being capable of conforming to the inner surface of the cup, and a plurality of skin-contacting elements attached to each rod along the length of the rod, wherein the rotator is capable of sweeping the rods along at least a portion of the inner surface of the cup to roll the skin-contacting elements against a breast supported by the inner surface of the cup.

3. The breast massager of claim 2 wherein the flexible rods are positioned opposite one another in the cup.

4. The breast massager of claim 1 wherein the rotator further includes a driver for rotating the rotating shaft.

5. The breast massager of claim 1 wherein each skin-contacting element comprises a spherical element having a shaft for passing the rod therethrough, the spherical element being capable of rotating along the axis of the rod.

6. The breast massager of claim 5 wherein each spherical element has a radius, and the radii of the spherical elements decrease along the length of the rod from the first end of the rod to the second end of the rod.

7. A breast massager comprising:

(a) a pair of cups for supporting a pair of breasts, each cup having an inner surface for supporting a breast, a tip corresponding to the tip of a breast, and an opening at the tip of the cup;

(b) a pair of rotators, each rotator attached to the tip of a cup, each rotator having a rotating shaft protruding into a corresponding cup via the opening at the tip of the cup;

(c) at least one flexible rod in each cup, each rod having a length, a first end and a second end, the first end of each rod being attached to the rotating shaft of a rotator in the corresponding cup, the rod being capable of conforming to the inner surface of the cup; and (d) a plurality of skin-contacting elements attached to each rod along the length of each rod;

wherein, each rotator is capable of sweeping at least one rod along at least a portion of the inner surface of a corresponding cup to roll the skin-contacting elements against a breast supported by the inner surface of the cup.

8. The breast massager of claim 7 further comprising: (i) a connector for connecting the cups to one another to form a bra, and (ii) straps attached to the cups for supporting the cups on the body of a wearer.

9. The breast massager of claim 7 wherein each rotator further includes a driver for rotating the rotating shaft of said rotator.

10. The breast massager of claim 7 wherein each skin-contacting element comprises a spherical element having a shaft for passing a flexible rod therethrough, the spherical element being capable of rotating along the axis of said flexible rod.

11. The breast massager of claim 10 wherein each spherical element has a radius, and the radii of the spherical elements decrease along the length of each rod from the first end of the rod to the second end of the rod.

12. A breast massager comprising:

(a) a pair of cups for supporting a pair of breasts, each cup having an inner surface for supporting a breast, a tip corresponding to the tip of a breast, and an opening at the tip of the cup;

(b) a pair of rotators, each rotator attached to the tip of a cup, each rotator having a rotating shaft protruding into a corresponding cup via the opening at the tip of the cup;

(c) a pair of flexible rods in each cup, each rod having a length, a first end and a second end, the first end of each rod being attached to the rotating shaft of a rotator in the corresponding cup, the rod being capable of conforming to the inner surface of the cup;

(d) a plurality of skin-contacting elements attached to each rod along the length of each rod;

wherein, each rotator is capable of sweeping the rods in a corresponding cup along at least a portion of the inner surface of the cup to roll the skin-contacting elements against a breast supported by the inner surface of the cup;

(e) a connector for connecting the cups to one another to form a bra; and (f) at least one strap attached to the cups for supporting the cups on the body of a wearer.

13. The breast massager of claim 12 wherein the flexible rods are positioned opposite one another in each cup.

14. The breast massager of claim 12 wherein each rotator further includes a driver for rotating the rotating shaft of the rotator.

15. The breast massager of claim 12 wherein each skin-contacting element comprises a spherical element having a shaft for passing a rod therethrough, the spherical element being capable of rotating along the axis of said rod.

16. The breast massager of claim 15 wherein each spherical element has a radius, and the radii of the spherical elements decrease along the length of each rod from the first end of the rod to the second end of the rod.

17. The breast massager of claim 12 wherein the skin-contacting elements are uniformly spaced along the length of each rod.

* * * * *